US005660132A

United States Patent [19]

Pasley

[11] Patent Number: 5,660,132

[45] Date of Patent: Aug. 26, 1997

[54] APPARATUS FOR ADJUSTING AND CONTROLLING THE POSITION OF A TROLLING MOTOR RELATIVE TO A WATERCRAFT

[76] Inventor: B. Phil Pasley, 277 Leo, Shreveport, La. 71105

[21] Appl. No.: 550,345

[22] Filed: Oct. 27, 1995

[51] Int. Cl.[6] ..... B63H 25/00

[52] U.S. Cl. ..... 114/144 R; 440/6; 74/480 B

[58] Field of Search ..... 440/53, 63, 62, 440/6, 7; 74/480 B, 494; 114/144 R, 146

[56] References Cited

U.S. PATENT DOCUMENTS

| | | | |
|---|---|---|---|
| 2,365,490 | 12/1944 | Pieron | 115/18 |
| 3,174,357 | 3/1965 | Conklin | 74/480 |
| 3,955,438 | 5/1976 | Zakrzewski | 74/480 B |
| 4,474,560 | 10/1984 | Weaver | 440/6 |
| 4,573,930 | 3/1986 | Queen | 440/63 |
| 4,604,066 | 8/1986 | Davatz | 440/7 |
| 4,656,960 | 4/1987 | Davenport | 74/480 B |
| 4,681,056 | 7/1987 | Friedle et al. | 114/146 |
| 4,916,969 | 4/1990 | Henning | 74/480 B |
| 5,046,974 | 9/1991 | Griffin, Jr. et al. | 440/63 |
| 5,145,427 | 9/1992 | Kawai et al. | 440/52 |
| 5,439,401 | 8/1995 | Clark | 440/6 |
| 5,453,030 | 9/1995 | Broussard | 440/6 |
| 5,507,242 | 4/1996 | LeBlanc et al. | 440/6 |

*Primary Examiner*—Edwin L. Swinehart

*Attorney, Agent, or Firm*—John F. Sieberth; R. Andrew Patty, II

[57] ABSTRACT

A device is described for adjusting the position of a trolling motor relative to a boat. The device has an arm, preferably L-shaped, with one end connected to the steering column of the trolling motor. The other end is higher than the first end and rotatably connected to an end of a handle bar, which is adapted, upon application of force thereto, to cause the arm to rotate with the steering column on the axis of the steering column up to and through at least 180°, and preferably through 360°. The device enables the position the trolling motor to be readily adjusted simply by pushing the handle bar away from, or pulling the handle bar toward, the operator. The device is less complicated and more durable than previously known devices, and allows for steering through the full range of steering column rotation while the operator remains fully within the perimeter of the boat. Thus, the device provides both a safe and convenient method of steering the boat while propelled by a trolling motor.

43 Claims, 8 Drawing Sheets

APPARATUS FOR ADJUSTING AND CONTROLLING THE POSITION OF A TROLLING MOTOR RELATIVE TO A WATERCRAFT

TECHNICAL FIELD

This invention relates to apparatus enabling the position of a trolling motor to be readily adjusted and controlled by a person remaining fully within the perimeter of a boat or other watercraft device, and to methods of accomplishing this highly desirable result.

BACKGROUND

There are two basic types of steering mechanisms for trolling motors manufactured today, electrical and operator-actuated (i.e., physically operated by hand or foot without electrical steering assistance). Examples of electrical steering mechanisms for trolling motors have been described in U.S. Pat. No. 5,453,030 to Broussard, and U.S. Pat. No. 4,604,066, to Davatz. Examples of operator-actuated mechanisms are described in U.S. Pat. No. 5,046,974 to Griffin et al., and U.S. Pat. No. 4,681,056 to Friedle et al. By their very nature, electrical steering mechanisms are more complicated and costly, require more maintenance, and are more susceptible to deterioration from exposure to weather and water as compared to operator-actuated steering mechanisms. Operator-actuated steering mechanisms on trolling motors provide easier boat control as they are simple units with no cables and few wires. Among the operator-actuated steering mechanisms, hand-controlled steering mechanisms are generally easier to use when compared to foot-controlled mechanisms, and are therefore more popular.

Unfortunately, hand-controlled trolling motors have required either a considerable amount of bending over by the operator to steer them, or provision of a control item, such as an extension handle affixed to the trolling motor steering column. The known extension handles reduced, but did not eliminate, the bending required on the part of the operator. Also, in order to alter the direction of boat travel with many of these prior extension handles, it has been necessary to push the handle in a port or starboard direction to thereby turn the trolling motor steering column. However, except for slight turns in a port or starboard direction, it has been necessary to push the extension handle out over the water. Such an operation was clearly unsafe and hazardous, since the operator could readily lose balance and fall overboard or tip the boat into an unsafe position. Moreover, the handle could not be used to reverse the direction of travel of the trolling motor. Instead, it was necessary to place the trolling motor in reverse or manually spin the handle 180 degrees from the boat with loss of considerable leverage potentially available from the extension handle. Many anglers use their feet to steer, by kicking the extension handle to change directions. But this too can be hazardous, as the operator has one foot off of the boat deck when performing this maneuver, and is therefore in an off-balance posture.

Accordingly, the above known methods of steering a trolling motor can be, at least to some degree, dangerous, as well as complicated, inconvenient and less than satisfactory. A need therefore exists for a more convenient, less complicated and safer way of altering and controlling the position of a trolling motor relative to the boat with which it is associated. This invention is deemed to fulfill this need in a highly effective and efficient manner.

THE INVENTION

The present invention alleviates all of the above problems by providing a device configured and constructed such that manual pivoting of the trolling motor can be accomplished with an extension handle that is always directly in front of the angler. To change directions, a simple push or pull on a handle is all that is needed. By pushing the handle completely forward a relatively short distance, the trolling motor can be rotated up to 180 degrees, thereby completely reversing the direction of travel. To resume forward motion requires nothing more than simply pulling back on the handle to its original position. The present invention also provides the full range of rotational motion for controlling a trolling motor, allowing for up to and through 360° of rotation. The angler is therefore no longer required to lean out over the water to turn or backup, or required to kick to change direction.

In accordance with one of its embodiments, this invention thus provides a device for adjusting the position relative to a watercraft of a trolling motor mounted thereon to propel the watercraft and having an upstanding steering column adapted to be axially rotated. The device comprises (a) an arm having first and second end portions angularly displaced from each other, wherein the first end portion is detachably connectable to the steering column and adapted, when so connected, to rotate with the steering column on the axis of the steering column up to and through at least 180° and wherein the second end portion is laterally displaced from the axis of the steering column and disposed above the first end portion, and (b) a handle bar having a forward end portion proximate to the second end portion of the arm and a rear end portion remote from the second end portion of the arm, the handle bar being rotatably connected to the second end portion and adapted, upon application of force to the handle bar, to cause the arm to revolve around the axis of the steering column up to and through at least 180°.

In another embodiment of this invention, the rotatable connection between the handle bar and the second end portion of the arm comprises at least one flange extending from the second end portion, at least one flange extending from the forward end portion of the handle bar, and means rotatably connecting the flanges in close proximity to each other. These flanges are disposed either in a substantially horizontal plane or in a substantially vertical plane. In addition, it is desirable to position at least one washer, preferably made from polytetrafluoroethylene, between the respective flanges to facilitate rotation of the connection.

In another embodiment, the arm has a generally L-shaped configuration such that, when the first end portion thereof is detachably connected to the steering column and the steering column is in a substantially vertical position, the first end portion is substantially perpendicular to the steering column and the second end portion of the arm is substantially parallel to the steering column. In addition, the rotatable connection between the handle bar and the second end portion comprises (a) a flange having a first segment and a second segment, wherein the first segment of the flange is transverse and rotatably connected to the second end portion of the arm, and wherein the second segment extends upwardly at approximately 90° from the first segment and is in a plane substantially co-planar with or substantially parallel to the axis of the second end portion, and wherein the second segment has an aperture therethrough, and (b) connecting means extending through the aperture and through an aperture in the forward end portion of the handle bar to pivotally and adjustably connect the handle bar to the flange.

In yet another embodiment of the invention, the rotatable connection between the handle bar and the second end portion of the arm comprises (a) at least two substantially parallel retainer flanges extending from the forward end portion of the handle bar, the retainer flanges being laterally spaced from each other, each retainer flange having an aperture therethrough, (b) a connection member rotatably affixed to the second end portion for axial rotation thereon, the connection member including a base plate transverse to the second end portion of the arm, and at least one upstanding flange, each upstanding flange having an aperture therethrough, the upstanding flanges being sized and configured to proximately fit between laterally adjacent retainer flanges of the forward end portion of the handle bar for rotation between the retainer flanges of the forward end portion of the handle bar when all of the apertures are in alignment with each other, and (c) connecting means extending through the apertures to pivotally connect and adjustably connect the handle bar to the connection member.

In a preferred embodiment, the first end portion of the arm is detachably connectable to the steering column and adapted, when so connected, to rotate with the steering column on the axis of the steering column up to and through 360°, and the handle bar is rotatably connected to the second end portion and adapted, upon application of force to the handle bar, to cause the arm and the steering column to rotate on the axis of the steering column through any angle up to and through 360°. In addition:

a) the arm has a generally L-shaped configuration such that, when the first end portion is detachably connected to the steering column and the steering column is in a substantially vertical position, the first end portion is substantially perpendicular to the steering column and the second end portion is laterally displaced from and substantially parallel to the steering column;

b) the rotatable connection between the handle bar and the second end portion comprises i) a connection member rotatably affixed to the second end portion for axial rotation thereon, the connection member including a base plate transverse to the second end portion, and at least two substantially parallel upstanding flanges laterally spaced from each other, each of the upstanding flanges having an aperture therethrough;

ii) one or more interposed flanges extending from the forward end portion of the handle bar, each of the interposed flanges having an aperture therethrough, the interposed flanges being sized and configured to proximately fit between laterally adjacent upstanding flanges of the connection member for rotation between the upstanding flanges of the connection member when all of the apertures are in alignment with each other; and iii) connecting means extending through the apertures to pivotally connect and adjustably connect the handle bar to the connection member;

c) the handle bar has a generally L-shaped configuration such that the rear end portion is upstanding; and d) the first end portion of the arm has clamp means for effecting the detachable connection between the arm and the steering column.

Most preferably, the rear end portion of the handle in this embodiment further comprises a manually actuatable electrical switch for making and breaking an electrical circuit between the trolling motor and an electrical power source therefor.

Another embodiment of this invention is an apparatus for propelling a watercraft which comprises a trolling motor propulsion system including an electric trolling motor and housing therefor, a propeller assembly and an upstanding steering column for adjusting the direction of propulsion produced by the propeller assembly when operative, and a device of this invention connected to the steering column of the trolling motor propulsion system. It will be noted that the configuration of the arm connected to the steering column and the rotary movement of the arm made possible by the rotatable connection between the arm and the handle bar enable the arm to be rotated with the steering column without engaging the housing anywhere through 180° and more preferably through 360° of rotation.

Still another embodiment of this invention is the method of adjusting the position of a trolling motor relative to a boat or other suitable watercraft on which it is mounted where the trolling motor has an upstanding steering column adapted to be axially rotated to change the direction of propulsion. The method comprises detachably attaching a device of this invention to the steering column and applying forward or backward force to the handle bar to cause the arm of the device and the steering column to rotate in unison up to and through at least 180° and preferably 360° on the axis of the steering column.

These and other embodiments and features of the invention will become still further apparent from the ensuing description, appended claims and accompanying drawings.

BRIEF DESCRIPTION OF THE DRAWINGS

In FIGS. 1A, 1B, 2, 3A and 3B, like letters are used to refer to like parts among the several views. In all of the other figures (except FIG. 7D), like numerals are used to refer to like parts among the several views.

BRIEF DESCRIPTION OF PRIOR ART

Figure 1A:
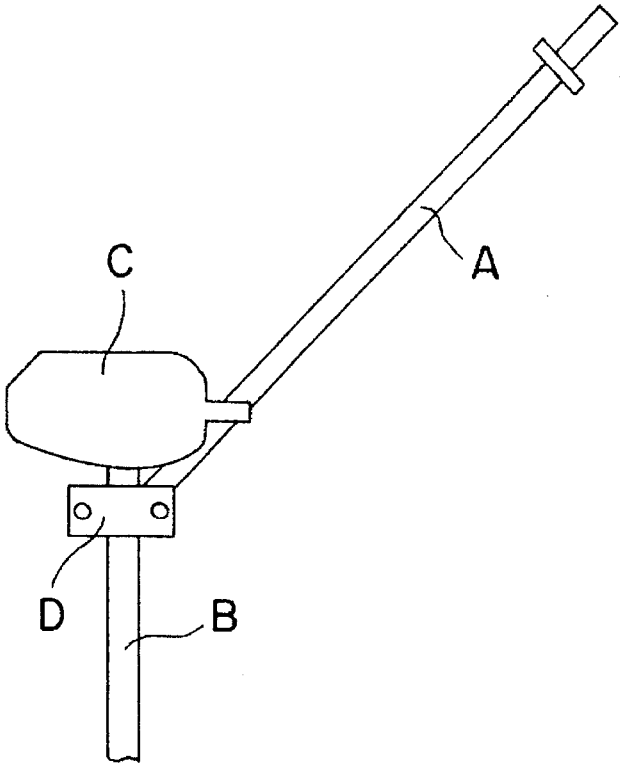
FIG. 1A PRIOR ART
FIG. 1A is a partially fragmentary side view of a typical prior art device used to steer a trolling motor by applying manual force to a handle connected to the steering column.
Figure 1B:
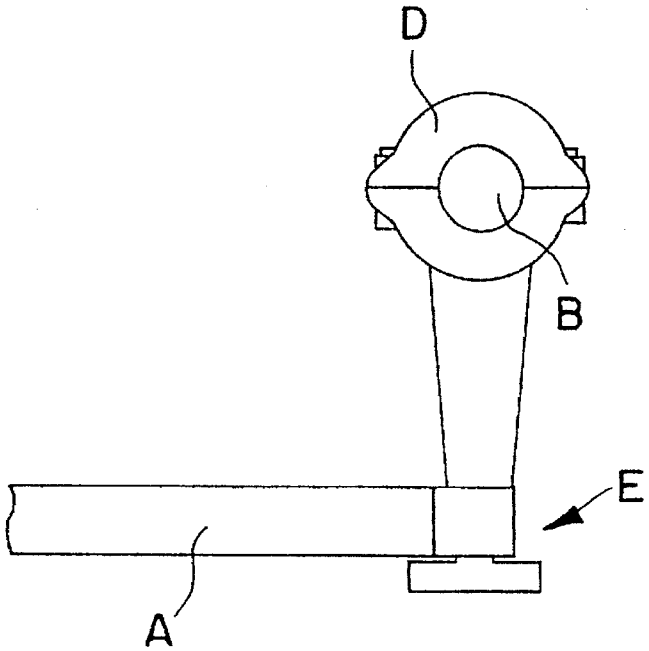
FIG. 1B PRIOR ART
FIG. 1B is a fragmentary top view of the connection between the handle bar and a vertical trolling motor steering column used in the prior art device depicted in FIG. 1A.
Figure 2:
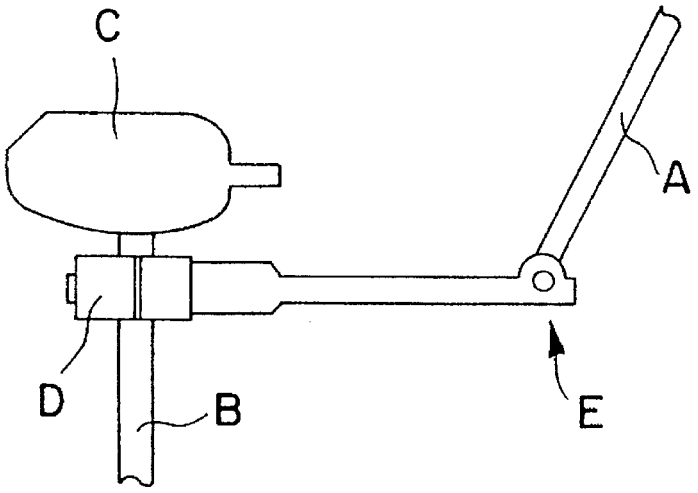
FIG. 2 PRIOR ART
FIG. 2 is a partially fragmentary side view of another typical prior art device for steering a trolling motor by applying manual force to a handle connected to the steering column by a horizontal, linear extension bar.
Figure 3A:
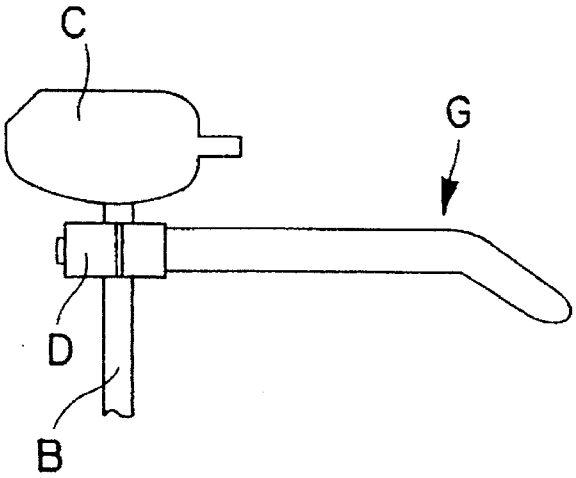
FIG. 3A PRIOR ART
FIG. 3A is a partially fragmentary side view of a foot-controlled device of the prior art for use in axially rotating a trolling motor steering column.
Figure 3B:
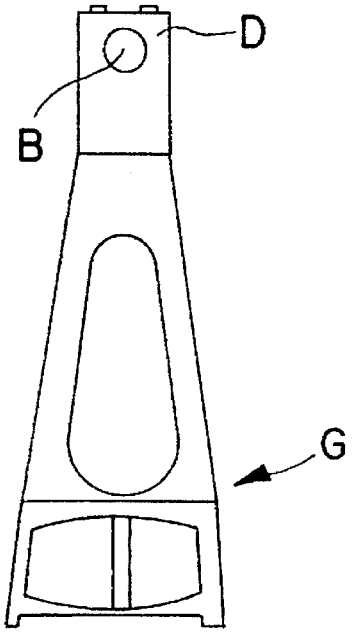
FIG. 3B PRIOR ART
FIG. 3B is a top view of the foot-controlled device depicted in FIG. 3A when detached from the steering column of the trolling motor.

Referring now to the drawings, FIGS. 1A through 3B illustrate a variety of known operator-actuated steering mechanisms for trolling motors. In particular, FIGS. 1A–2 illustrate examples of operator-actuated steering mechanisms designed for manual actuation, while FIGS. 3A and 3B illustrate an example of a steering mechanism designed for foot actuation. In FIGS. 1A–2, it can be seen that each device has a handle bar A which is attached to a steering column B of a trolling motor C by clamping means D. A pivotal connection E is provided to permit the vertical adjustment of handle bar A. When operative, these designs require handle bar A to revolve around the axis of steering column B, making high degrees of rotation of the steering column difficult for a person on board the watercraft. A foot-actuated design, illustrated in FIGS. 3A and 3B, has foot rest G which is attached to steering column B by clamping means D. As in the case of the manually-actuated designs illustrated in FIGS. 1A–2, this design requires foot rest G to revolve around the axis of steering column B, making high degrees of rotation of the steering column difficult, if not impossible, for a person on board the watercraft.

FURTHER DESCRIPTION OF THE INVENTION

As previously noted, the device of this invention is particularly adapted for use in adjusting and controlling the position, relative to a boat or other watercraft, of a trolling motor having a steering column thereon.

Figure 4A:
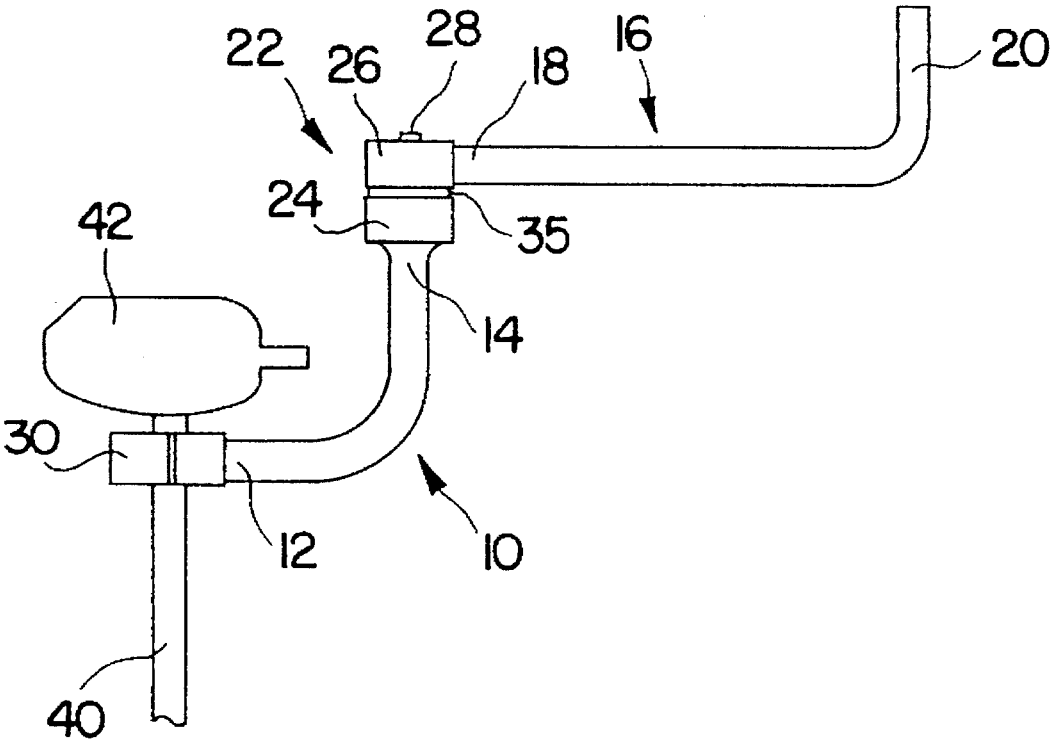
FIG. 4A is a partially fragmentary side view of one preferred embodiment of this invention where the device attached to the steering column of a trolling motor has, inter alia, a rotatable connection between the arm and the handle bar involving a pair of horizontal flanges.
Figure 9A:
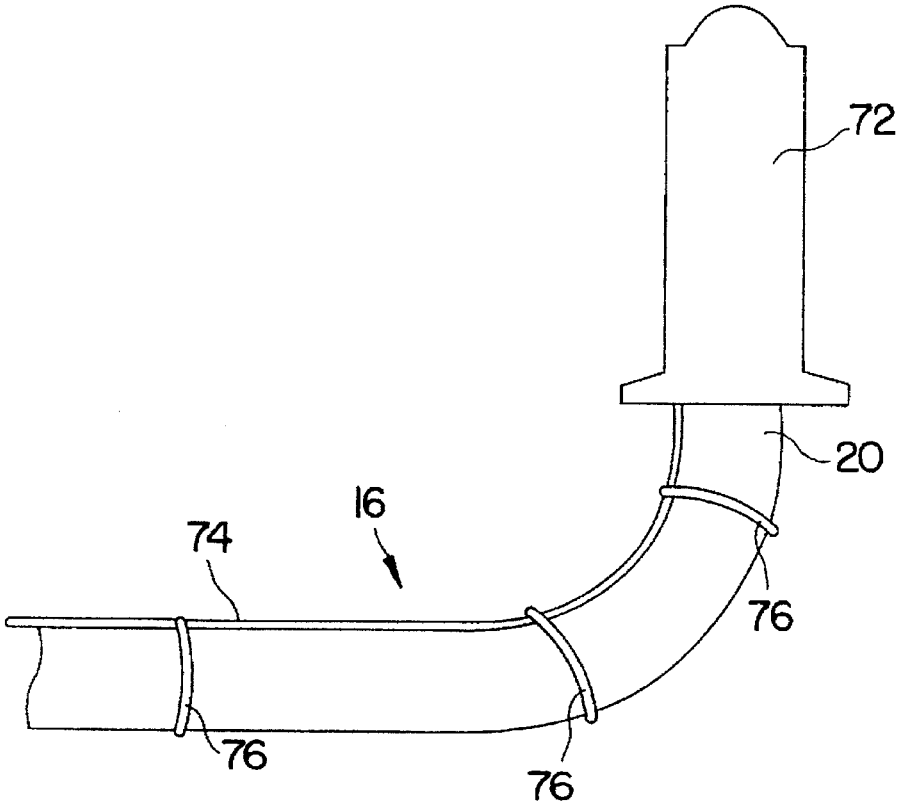
FIG. 9A is a fragmentary side view of the handle of an embodiment of the invention.
Figure 9B:
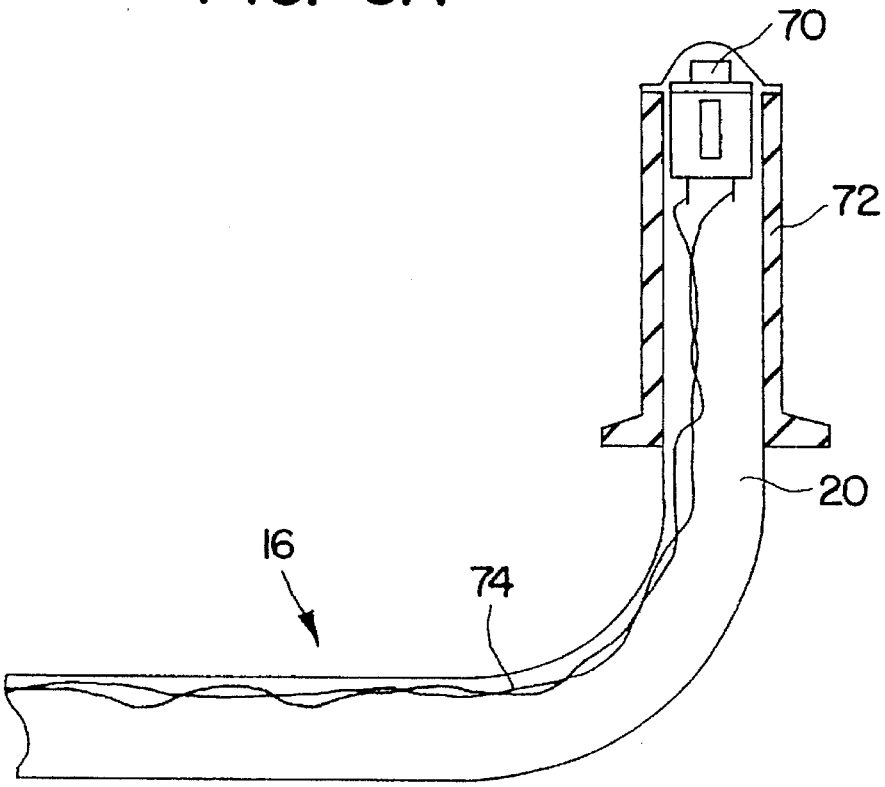
FIG. 9B is a fragmentary side view in cross-section of the handle of another embodiment of the invention.

In the forms depicted commencing with FIG. 4A and extending through FIG. 9B, the device of this invention comprises an arm 10 having a first end portion 12 angularly displaced from a second end portion 14 of arm 10. Arm 10 is detachably connected to steering column 40 of trolling motor 42 by clamp means 30 disposed at first end portion 12. First end portion 12 is adapted, when so connected, to rotate with steering column 40 on the axis of steering column 40 up to and through at least 180°, and preferably through 360°. Second end portion 14 is laterally displaced from the axis of steering column 40 and disposed above first end portion 12. Rotatably connected to second end portion 14 is a handle bar 16, having a forward end portion 18 proximate to second end portion 14, and a rear end portion 20. Handle bar 16 is adapted, upon application of force thereto, to cause arm 10 (including first end portion 12 and second end portion 14) to revolve around the axis of steering column 40 up to and through at least 180°, and preferably through 360°. Since arm 10 and steering column 40 are detachably connected together, force applied to handle bar 16 causes arm 10 and steering column 40 to rotate in unison on the axis of the steering column.

Figure 5A:
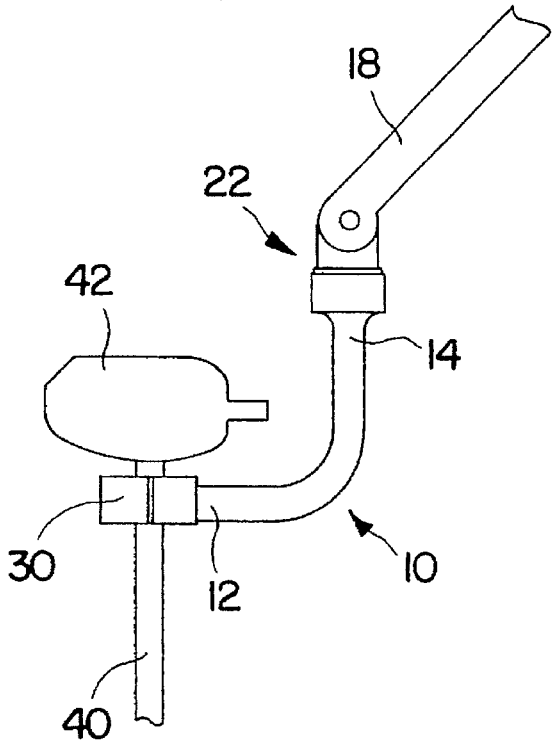
FIG. 5A is a fragmentary side view of another preferred embodiment of the invention in which the device attached to the upstanding steering column of the trolling motor has different form of rotatable connection means between the handle bar and the arm of the device.
Figure 6A:
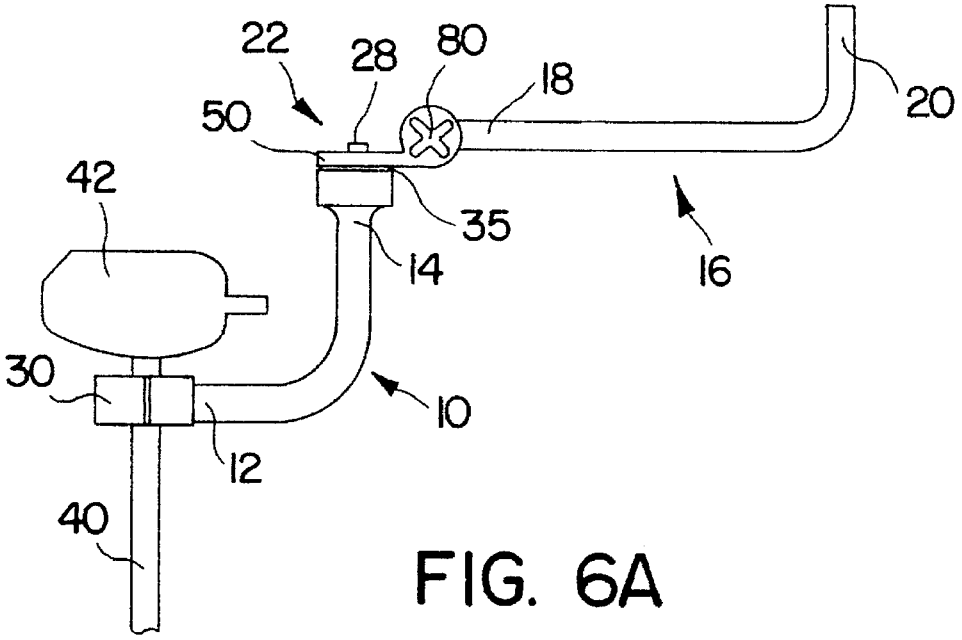
FIG. 6A is a partially fragmentary side view of still another preferred embodiment of the invention in which the device as depicted is attached to the steering column of a vertically positioned trolling motor.

As seen at FIGS. 4A, 5A and 6A, preferred embodiments of the subject invention have an arm 10 which is generally L-shaped in configuration such that, when first end portion 12 is detachably connected to steering column 40 and steering column 40 is in a substantially vertical position, first end portion 12 is substantially perpendicular to steering column 40 and second end portion 14 is substantially parallel to steering column 40. However, the arm of this invention may have other configurations of equal utility, so long as second end portion 14 is disposed above first end portion 12 to permit first end portion 12 and second end portion 14, when connected to handle bar 16, to revolve in unison around the axis of steering column 40 up to and through at least 180°. Additionally, in preferred embodiments of the invention handle bar 16 has a generally L-shaped configuration such that rear portion 20 is upstanding. In particularly preferred embodiments, handle bar 16 is generally L-shaped in configuration such that rear end portion 20 extends upwardly from handle bar 16, preferably at an angle of about 90°. As hereinafter described, in a particularly preferred embodiment rear end portion 20 is adapted to include an manually-actuated electrical switch for controlling electrical power to the trolling motor while permitting the simultaneous rotation of the steering column.

FIG. 4A illustrates one embodiment of the invention wherein arm 10 is detachably connected to steering column 40, and rotatable connection means 22 between handle bar 16 and second end portion 14 of arm 10 comprises flange 24 extending from second end portion 14, flange 26 extending from forward end portion 18, and connector 28 rotatably connecting flanges 24 and 26 in close proximity to each other. In addition, washer 35 is disposed between flanges 24 and 26 to facilitate rotation of connection 22. In this particular illustration, flanges 24 and 26 are disposed in a substantially horizontal plane, although they may be disposed in a substantially vertical plane in other embodiments of the subject invention.

Figure 4B:
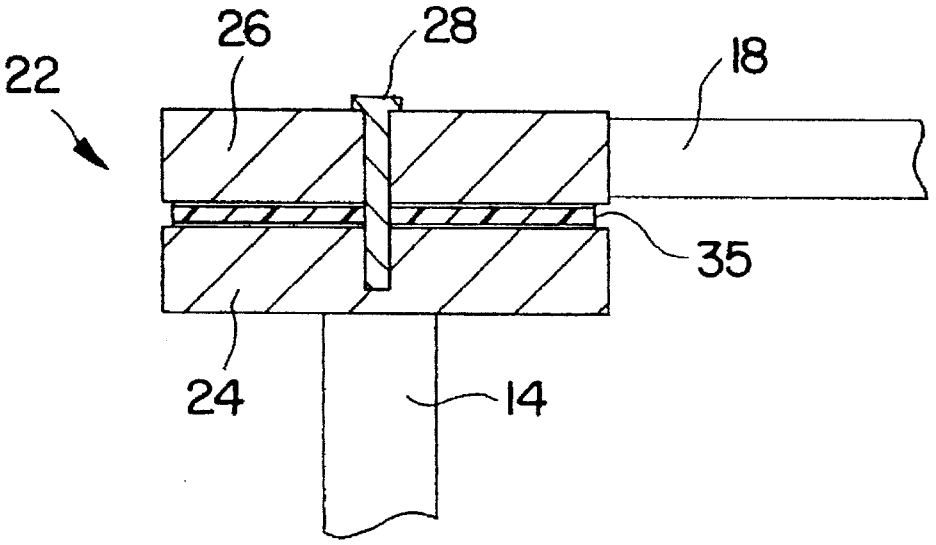
FIG. 4B is a fragmentary, cross-sectional side view of an embodiment of the invention such as depicted in FIG. 4A, and showing connecting means between the handle bar and the arm of the device.

FIG. 4B depicts an enlarged, cross-sectional side view of rotatable connection means 22 of the particular embodiment illustrated in FIG. 4A. Connector 28 is disposed between flanges 24 and 26 to rotatably connect them. Connector 28 may be any one of a number of types of connectors, including bolts or screws. Connector 28 is placed through washer 35, while washer 35 is disposed between flanges 24 and 26 to facilitate rotation of connection means 22. Washer 35 may be made from various materials, including metals, plastics or composite materials. In preferred embodiments, washer 35 is made of polytetrafluoroethylene or a similar fluoropolymer because of the toughness, durability, and suitable low friction properties of such materials.

Figure 5B:
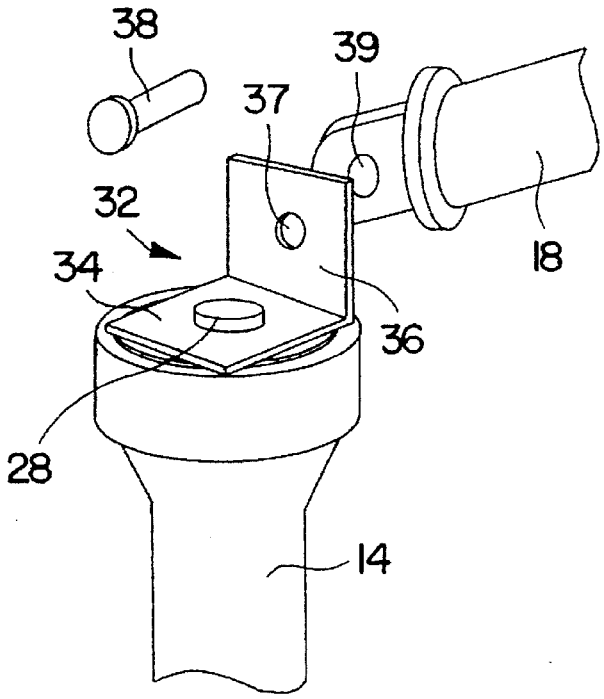
FIG. 5B is a fragmentary view in perspective of the partially disassembled means used to rotatably and pivotally connect the handle bar and the arm of an embodiment of the invention such as depicted in FIG. 5A.

FIGS. 5A and 5B illustrate another embodiment of the invention wherein arm 10 is detachably connected to steering column 40, and wherein rotatable connection 22 comprises a flange 32 having a first segment 34 which is transverse and rotatably connected to second end portion 14 by connector 28, and a second segment 36 which extends upwardly at approximately 90° from first segment 34, is in a plane substantially parallel to the axis of second end portion 14, and has an aperture 37. It should be noted that, in alternative embodiments, first segment 34 may be substantially co-planar with, rather than parallel with, the axis of second end portion 14. In the embodiment depicted, rotatable connection means 22 also includes connector 38 extending through aperture 37 and through an aperture 39 in forward end portion 18 of handle bar 16 to pivotally and adjustably connect handle bar 16 to flange 32. By "adjustably connect" is meant that by suitably tightening connector 38, handle bar 16 is kept in any selected angular position even when not held by the operator.

Particularly preferred embodiments of this invention are the devices depicted in FIGS. 6A through 8. In FIG. 6A, arm 10 is detachably connected to steering column 40, and rotatable connection 22 comprises a connection member 50 rotatably affixed by connector 28 to second end portion 14 for axial rotation thereon. Connector 28 is placed through washer 35 while washer 35 is interposed between second end portion 14 and connection member 50 to facilitate rotation thereof. Connection member 50 includes a base plate 52 transverse to second end portion 14, and two substantially parallel upstanding flanges 54 laterally spaced from each other, each of the upstanding flanges 54 having an aperture 55 therethrough. An interposed flange 56 extends from forward end portion 18 of handle bar 16 and has an aperture 57 therethrough. Interposed flange 56 is sized and configured to proximately fit between laterally adjacent upstanding flanges 54 of connection member 50 for rotation between upstanding flanges 54 when apertures 55 and 57 are in alignment with each other. Connector 38 extends through apertures 55 and 57 to pivotally connect and adjustably connect handle bar 16 to connection member 50. It will be noted that connector 38 has a handle 80 attached thereto for facilitating adjustment to the pivotal connection between handle bar 16 and connection member 50.

Figure 6B:
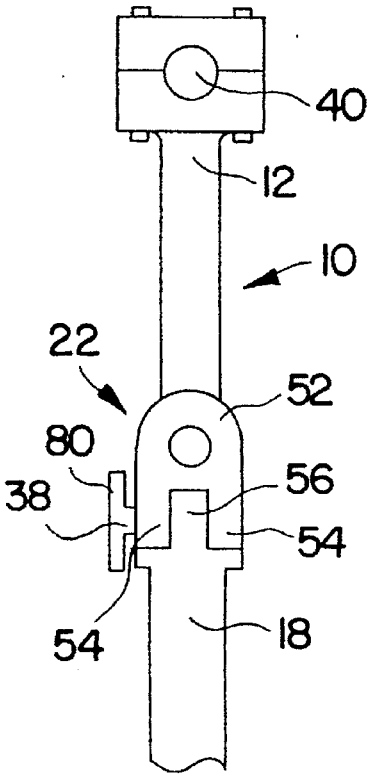
FIG. 6B is a fragmentary top view of the embodiment of the invention depicted in FIG. 6A.
Figure 6C:
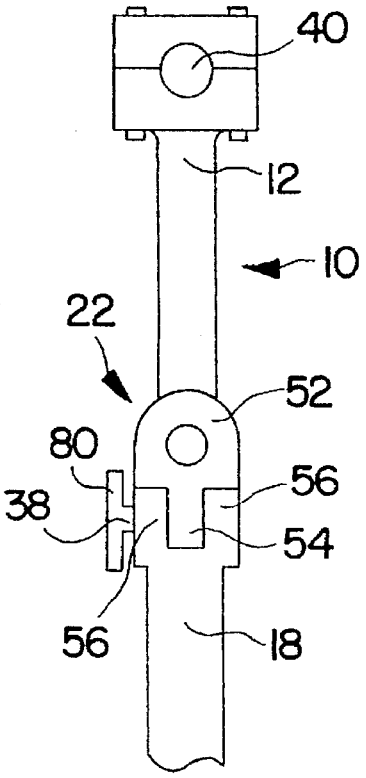
FIG. 6C is a variation of the embodiment illustrated in FIGS. 6A and 6B.

FIGS. 6B and 6C illustrate two alternative, but equally effective, embodiments of rotatable connection means 22. Specifically, FIG. 6B illustrates a fragmentary top view of arm 10 when connected at its second end portion 14 to handle bar 16 at rotatable connection 22. Connection member 50, of rotatable connection 22 includes a base plate 52 and, as described above, two substantially parallel upstanding flanges 54 laterally spaced from each other. A single interposed flange 56 extends from forward end portion 18 of handle bar 16. In contrast, FIG. 6C illustrates another form of rotatable connection means 22. In this form, forward end portion 18 of handle bar 16 has two substantially parallel flanges 56 extending therefrom. Connection member 50 includes a base plate 52 and only one upstanding flange 54, which is interposed between flanges 56. FIGS. 6B and 6C illustrate that neither the number of flanges involved in rotatable connection means 22, nor the particular placement of those flanges is critical, provided that the rotatable characteristic of the connection is not adversely affected.

Figure 7A:
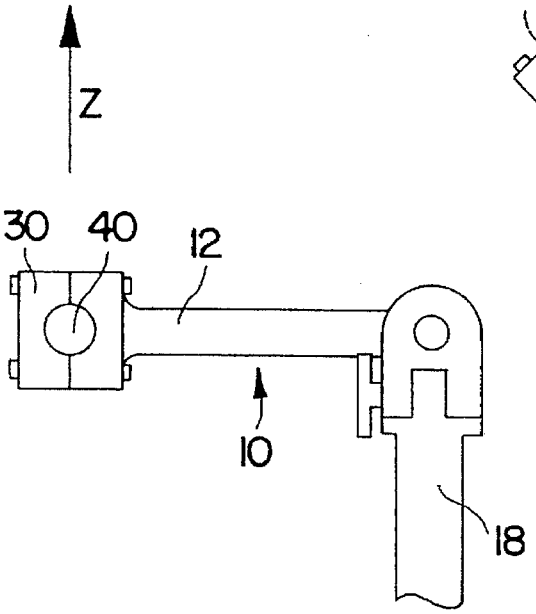
FIGS. 7A, 7B and 7C is three different fragmentary top views of the embodiment depicted in FIG. 6B illustrating some of the possible angular dispositions of the arm of the device when attached to a steering column, relative to the direction of travel produced by the trolling motor.
Figure 7B:
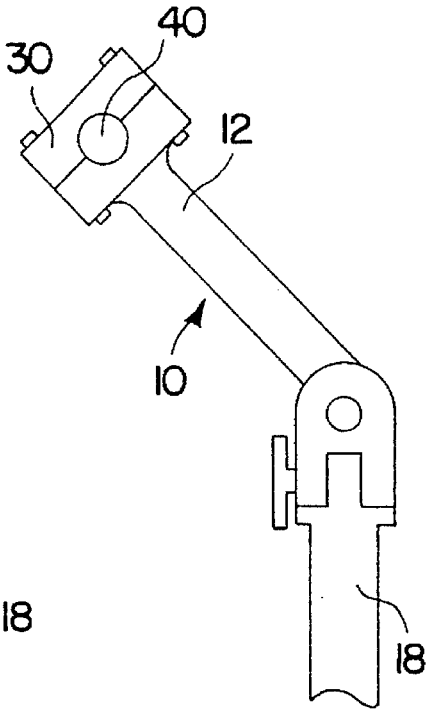
Figure 7C:
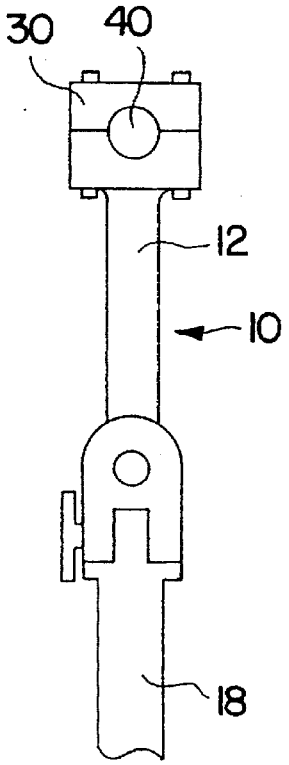
Figure 7D:
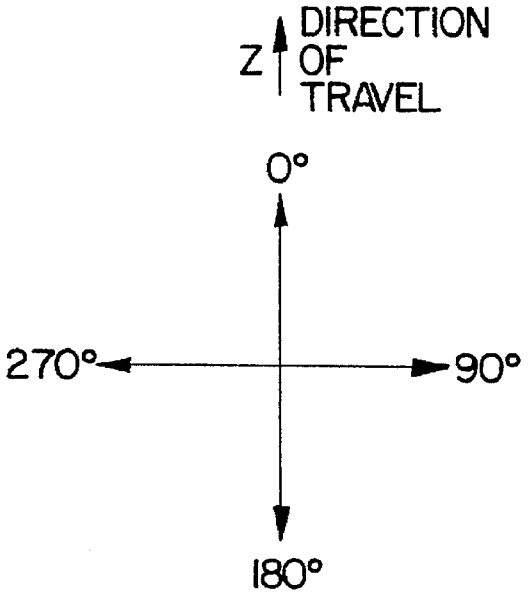
FIG. 7D depicts a pair of axes for illustrating angular dispositions between the arm and the direction of travel produced by a trolling motor.
Figure 8:
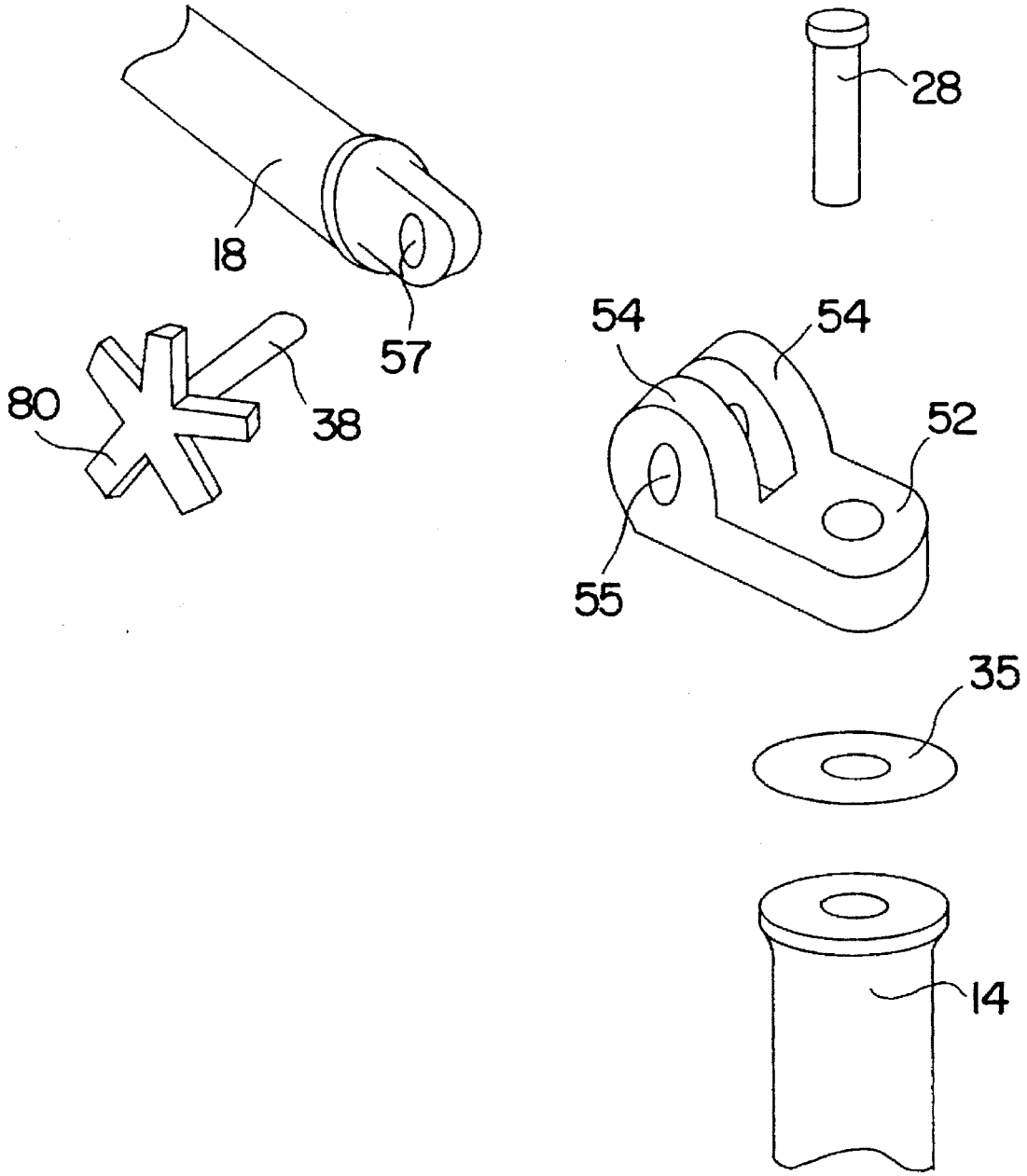
FIG. 8 is a view in perspective of the various parts of the means used to connect the handle bar and the arm of the embodiment of the invention depicted in FIGS. 6A, 6B, 7A, 7B and 7C.

First end portion 12 of arm 10 of the device of this invention is detachably connectable to steering column 40 at any angle relative to the direction of travel produced by the trolling motor. This is illustrated by FIGS. 7A, 7B and 7C considered collectively, wherein, in each case, the direction of travel is as indicated by arrow Z of FIG. 7A. In this connection, FIG. 7D provides, for reference purposes, the x-y axis utilized herein to describe the angles relative to the direction of travel. Thus, in FIG. 7A, first end portion 12 is detachably connected to steering column 40 at an angle of approximately 90° relative to the direction of travel, and this constitutes a particularly preferred embodiment of the invention. In FIG. 7B, this angular connection is approximately 135° relative to the direction of travel, while the angular connection in FIG. 7C is approximately 180°. Although any angle of connection may be used, preferably the connection between first end portion 12 and steering column 40 is at an angle between about 45° to about 135° relative to the direction of travel produced by the trolling motor, as connections within this range provide for maximum leverage when changing the direction of travel produced by the trolling motor. The angles described above assume use by a right-handed operator. For left-handed operators, the above angles should be increased by 180°. Thus, for left-handed operators, it is preferred that the connection between first end portion 12 and steering column 40 be at an angle between about 225° to about 315° relative to the direction of travel produced by the trolling motor. Additionally, in a particularly preferred embodiment for use by left-handed operators, the angle of this connection will be at approximately 270°.

In a particularly preferred embodiment of the invention, depicted in FIGS. 9A and 9B, rear end portion 20 further comprises a manually actuatable electrical switch 70 for making and breaking an electrical circuit between trolling motor 42 and an electrical power source (not shown), such as a storage battery or electric generator. In the embodiment depicted, rear end portion 20 is covered by a water-proof handle 72 to facilitate manual control of handle bar 16 and to cover switch 70, thereby protecting switch 70 from weather and water while permitting manual actuation of switch 70. Incorporating switch 70 into the circuit which controls electric power to the trolling motor may be accomplished by numerous wiring methods. For example, insulated electrical wire 74 may be clamped onto the exterior of the device by clamps 76, as depicted in FIG. 9A, or threaded through handle bar 16, as depicted in FIG. 9B. In the embodiment depicted, switch 70 is designed to be thumb actuated, but numerous other embodiments, including a trigger switch designed for index finger actuation, and a bar switch incorporated in or attached to the rear end portion of the handle bar and designed to be actuated upon a squeeze of the handle, are similarly convenient and effective. Additionally, switch 70 may be either a momentary switch, i.e., one which makes the circuit only so long as it is manually actuated, and promptly breaks the circuit upon release, or a constant or continuous switch, i.e., one which upon actuation makes the circuit without further actuation, and until such time as the switch is further manipulated to break the circuit.

The clamp means, arm, rotatable connection, connection member, handle bar, and accompanying connecting means of the device of this invention may be constructed of a wide variety of metals, rigid plastics or composite materials. In preferred embodiments, these individual parts of the device are constructed of lightweight aluminum or stainless steel, as these materials are strong and durable. The arm and handle bar may be either of hollow or solid construction; however, hollow pipe construction is preferred, as it is strong yet light weight and permits for insertion of internal electrical wiring, where desired.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A device for adjusting the position relative to a watercraft of a trolling motor mounted thereon to propel said watercraft and having an upstanding steering column adapted to be axially rotated, said device comprising a) an arm having first and second end portions angularly displaced from each other, wherein said first end portion is detachably connectable to said steering column and adapted, when so connected, to rotate with the steering column on the axis of said steering column up to and through at least 180° and wherein said second end portion is laterally displaced from the axis of said steering column and disposed above said first end portion; and b) a handle bar having a forward end portion proximate to said second end portion and a rear end portion remote from said second end portion, said handle bar being rotatably connected to said second end portion and adapted, upon application of force to said handle bar, to cause said first and second end portions to revolve in unison around the axis of the steering column up to and through at least 180°;

said arm having a generally L-shaped configuration such that, when said first end portion is detachably connected to said steering column and said steering column is in a substantially vertical position, said first end portion is substantially perpendicular to said steering column and said second end portion is substantially parallel to said steering column.

2. A device according to claim 1 wherein the rotatable connection between said handle bar and said second end portion comprises at least one flange extending from said second end portion, at least one flange extending from the forward end portion of said handle bar, and means rotatably connecting said flanges in close proximity to each other, said flanges being disposed either in a substantially horizontal plane or in a substantially vertical plane.

3. A device according to claim 2 wherein at least one washer is juxtaposed between the respective flanges to facilitate rotation of said connection.

4. A device according to claim 3 wherein said washer is made of polytetrafluoroethylene.

5. A device according to claim 1 wherein the rotatable connection between said handle bar and said second end portion comprises (a) a flange having a first segment and a second segment, wherein said first segment is transverse and rotatably connected to said second end portion, and wherein said second segment extends upwardly at approximately 90° from said first segment and is in a plane substantially co-planar with or substantially parallel to the axis of said second end portion, and wherein said second segment has an aperture therethrough, and (b) connecting means extending through said aperture and through an aperture in the forward end portion of said handle bar to pivotally and adjustably connect said handle bar to said flange.

6. A device according to claim 1 wherein the rotatable connection between said handle bar and said second end portion comprises:

a) a connection member rotatably affixed to said second end portion for axial rotation thereon, said connection member including a base plate transverse to said second end portion, and at least two substantially parallel upstanding flanges laterally spaced from each other, each said upstanding flange having an aperture therethrough;

b) one or more interposed flanges extending from the forward end portion of said handle bar, each said interposed flange having an aperture therethrough, said interposed flanges being sized and configured to proximately fit between laterally adjacent upstanding flanges of said connection member for rotation between the upstanding flanges of the connection member when all of said apertures are in alignment with each other; and c) connecting means extending through said apertures to pivotally connect and adjustably connect said handle bar to said connection member.

7. A device according to claim 6 wherein said connection member has two said upstanding flanges and wherein the forward end portion of said handle bar has one said flange.

8. A device according to claim 1 wherein the rotatable connection between said handle bar and said second end portion comprises:

a) at least two substantially parallel retainer flanges extending from the forward end portion of said handle bar, said retainer flanges being laterally spaced from each other, each retainer flange having an aperture therethrough;

b) a connection member rotatably affixed to said second end portion for axial rotation thereon, said connection member including a base plate transverse to said second end portion, and at least one upstanding flange, each said upstanding flange having an aperture therethrough, said upstanding flanges being sized and configured to proximately fit between laterally adjacent retainer flanges of the forward end portion of said handle bar for rotation between the retainer flanges of the forward end portion of said handle bar when all of said apertures are in alignment with each other; and c) connecting means extending through said apertures to pivotally connect and adjustably connect said handle bar to said connection member.

9. A device according to claim 8 wherein the forward end portion of said handle bar has two said retainer flanges and wherein said connection member has one said upstanding flange.

10. A device according to claim 1 wherein said handle bar has a generally L-shaped configuration such that the rear end portion of said handle bar is upstanding.

11. A device according to claim 1 wherein said handle bar has a generally L-shaped configuration such that the rear end portion extends upwardly from said handle bar at an angle of about 90°.

12. A device according to claim 11 wherein the rear end portion further comprises a manually actuatable electrical switch for making and breaking an electrical circuit between the trolling motor and an electrical power source therefor.

13. A device according to claim 1 wherein said first end portion of said arm has clamp means for effecting the detachable connection between said arm and said steering column.

14. A device according to claim 13 wherein said clamp means comprise (a) a first clamping member, and a second clamping member integrally connected to said first end portion, said members defining between respective confronting faces thereof a generally cylindrical space sized to receive and grasp said steering column when said faces are brought into and maintained in close proximity to each other, and (b) compressing means to bring and maintain said faces in close proximity to each other.

15. A device according to claim 14 wherein said compressing means comprise (i) one or more cooperatively sized nuts and bolts and one or more aligned apertures in said clamping members, or (ii) cooperatively sized machine screws to be received by one or more interiorly threaded and aligned apertures in said clamping members.

16. A device according to claim 1 wherein said first end portion of said arm is detachably connectable to said steering column and adapted, when so connected, to rotate with said steering column on the axis of said steering column up to and through 360°, and said handle bar is rotatably connected to said second end portion and adapted, upon application of force to said handle bar, to cause said first and second end portions to revolve in unison around the axis of said steering column up to and through 360°.

17. A device according to claim 16 wherein a) the rotatable connection between said handle bar and said second end portion comprises (i) a flange having first and second segments, wherein said first segment is rotatably connected to said second end portion, and wherein said second segment extends upwardly at approximately 90° from said first segment and is in a plane substantially co-planar with or substantially parallel to the axis of said second end portion, and wherein said second segment has an aperture therethrough, and (ii) connecting means extending through said aperture and through an aperture in the forward end portion of said handle bar to pivotally and adjustably connect said handle bar to said flange;

b) said handle bar has a generally L-shaped configuration such that the rear end portion is upstanding; and c) said first end portion of said arm has clamp means for effecting the detachable connection between said arm and said steering column.

18. A device according to claim 16, wherein a) the rotatable connection between said handle bar and said second end portion comprises:

i) a connection member rotatably affixed to said second end portion for axial rotation thereon, said connection member including a base plate transverse to said second end portion, and at least two substantially parallel upstanding flanges laterally spaced from each other, each said upstanding flange having an aperture therethrough;

ii) one or more interposed flanges extending from the forward end portion of said handle bar, each said interposed flange having an aperture therethrough, said interposed flanges being sized and configured to proximately fit between laterally adjacent upstanding flanges of said connection member for rotation between the upstanding flanges of the connection member when all of said apertures are in alignment with each other; and iii) connecting means extending through said apertures to pivotally connect and adjustably connect said handle bar to said connection member;

b) said handle bar has a generally L-shaped configuration such that the rear end portion is upstanding; and c) said first end portion of the arm has clamp means for effecting the detachable connection between said arm and said steering column.

19. A device according to claim 18, wherein the rear end portion further comprises a manually actuatable electrical switch for making and breaking an electrical circuit between the trolling motor and an electrical power source therefor.

20. A device according to claim 18, wherein said clamp means comprise (a) a first clamping member, and a second clamping member integrally connected to said first end portion, said members defining between respective confronting faces thereof a generally cylindrical space sized to receive and grasp said steering column when said faces are brought into and maintained in close proximity to each other, and (b) compressing means to bring and maintain said faces in close proximity to each other.

21. A device according to claim 16 wherein a) the rotatable connection between said handle bar and said second end portion comprises:

i) at least two substantially parallel retainer flanges extending from the forward end portion of said handle bar, said retainer flanges being laterally spaced from each other, each retainer flange having an aperture therethrough;

ii) a connection member rotatably affixed to said second end portion for axial rotation thereon, said connection member including a base plate transverse to said second end portion, and at least one upstanding flange, each said upstanding flange having an aperture therethrough, said upstanding flanges being sized and configured to proximately fit between laterally adjacent retainer flanges of the forward end portion of said handle bar for rotation between the retainer flanges of the forward end portion when all of said apertures are in alignment with each other; and iii) connecting means extending through said apertures to pivotally connect and adjustably connect said handle bar to said connection member;

b) said handle bar has a generally L-shaped configuration such that the rear end portion of said handle bar is upstanding; and c) said first end portion of the arm leas clamp means for effecting the detachable connection between said arm and said steering column.

22. A device according to claim 20 wherein said upstanding rear end portion further comprises a manually actuatable electrical switch for making and breaking an electrical circuit between the trolling motor and an electrical power source therefor.

23. A device according to claim 20, wherein said clamp means comprise (a) a first clamping member, and a second clamping member integrally connected to said first end portion, said members defining between respective confronting faces thereof a generally cylindrical space sized to receive and grasp said steering column when said faces are brought into and maintained in close proximity to each other, and (b) compressing means to bring and maintain said faces in close proximity to each other.

24. Apparatus for propelling a watercraft which comprises a) a trolling motor propulsion system attached to said watercraft and comprising an electric trolling motor and housing therefor, a propeller assembly and an upstanding steering column for adjusting the direction of propulsion produced by said propeller assembly when operative;

b) an arm having first and second end portions angularly displaced from each other, wherein said first end portion is detachably connected to said steering column so as to rotate with said steering column on the axis of said steering column up to and through at least 180° and wherein said second end portion is laterally displaced from the axis of said steering column and disposed above said first end portion; and c) a handle bar having a forward end portion proximate to said second end portion and a rear end portion remote from said second end portion, said handle bar being rotatably connected to said second end portion and adapted, upon application of generally forward or backward force to said handle bar, to cause said first and second end portions to revolve in unison around the axis of the steering column up to and through at least 180° without engaging said housing said arm having a generally L-shaped configuration such that, when said first end portion is detachably connected to said steering column and said steering column is in a substantially vertical position, said first end portion is substantially perpendicular to said steering column and said second end portion is substantially parallel to said steering column.

25. Apparatus according to claim 24 wherein the rotatable connection between said handle bar and said second end portion comprises at least one flange extending from said second end portion, at least one flange extending from the forward end portion of said handle bar, and means rotatably connecting said flanges in close proximity to each other, said flanges being disposed either in a substantially horizontal plane or in a substantially vertical plane.

26. Apparatus according to claim 25 wherein at least one washer is juxtaposed between the respective flanges to facilitate rotation of said connection.

27. Apparatus according to claim 26 wherein said washer is made of polytetrafluoroethylene.

28. Apparatus according to claim 24 wherein said first end portion is detachably connectable to said steering column at an angle in the range of about 45° to about 135° relative to the direction of travel produced by the trolling motor.

29. Apparatus according to claim 24 wherein said first end portion of said arm is detachably connectable to said steering column and adapted, when so connected, to rotate with said steering column on the axis of said steering column up to and through 360°, and said handle bar is rotatably connected to said second end portion and adapted, upon application of force to said handle bar, to cause said first and second end portions to revolve in unison around the axis of the steering column up to and through 360°.

30. Apparatus according to claim 29, wherein said first end portion is detachably connectable to said steering column at an angle in the range of about 45° to about 135° relative to the direction of travel produced by the trolling motor.

31. Apparatus according to claim 24, wherein a) the rotatable connection between said handle bar and said second end portion comprises (i) a flange having first and second segments, wherein said first segment is rotatably connected to said second end portion, and wherein said second segment extends upwardly at approximately 90° from said first segment and is in a plane substantially co-planar with or substantially parallel to the axis of said second end portion, and wherein said second segment has an aperture therethrough, and (ii) connecting means extending through said aperture and through an aperture in the forward end portion of said handle bar to pivotally and adjustably connect said handle bar to said flange;

b) said handle bar has a generally L-shaped configuration such that the rear end portion of said handle bar is upstanding; and c) said first end portion of the arm has clamp means for effecting the detachable connection between said arm and said steering column.

32. Apparatus according to claim 24, wherein a) the rotatable connection between said handle bar and said second end portion comprises:

i) a connection member rotatably affixed to said second end portion for axis rotation thereon, said connection member including a base plate transverse to said second end portion, and at least two substantially parallel upstanding flanges laterally spaced from each other, each said upstanding flange having an aperture therethrough;

ii) one or more interposed flanges extending from the forward end portion of said handle bar, each said interposed flange having an aperture therethrough, said interposed flanges being sized and configured to proximately fit between laterally adjacent upstanding flanges of said connection member for rotation between the upstanding flanges of the connection member when all of said apertures are in alignment with each other; and iii) connecting means extending through said apertures to pivotally connect and adjustably connect said handle bar to said connection member;

b) said handle bar has a generally L-shaped configuration such that the rear end portion of said handle bar is upstanding; and c) said first end portion of the arm has clamp means for effecting the detachable connection between said arm and said steering column d) said first end portion of said arm is detachably connectable to said steering column at an angle in the range of about 45° to about 135° relative to the direction of travel produced by the trolling motor, and is adapted, when so connected, to rotate with said steering column on the axis of said steering column up to and through 360°, and said handle bar is rotatably connected to said second end portion and adapted, upon application of force to said handle bar, to cause said first and second end portions to revolve in unison around the axis of the steering column up to and through 360°.

33. Apparatus according to claim 32, wherein said upstanding rear end portion further comprises a manually actuatable electrical switch for making and breaking an electrical circuit between the trolling motor and an electrical power source therefor.

34. Apparatus according to claim 32, wherein said clamp means comprise (a) a first clamping member, and a second clamping member integrally connected to said first end portion, said members defining between respective confronting faces thereof a generally cylindrical space sized to receive and grasp said steering column when said faces are brought into and maintained in close proximity to each other, and (b) compressing means to bring and maintain said faces in close proximity to each other.

35. Apparatus according to claim 24, wherein a) the rotatable connection between said handle bar and said second end portion comprises:

i) at least two substantially parallel retainer flanges extending from the forward end portion of said handle bar, said retainer flanges being laterally spaced from each other, each retainer flange having an aperture therethrough;

ii) a connection member rotatably affixed to said second end portion for axial rotation thereon, said connection member including a base plate transverse to said second end portion, and at least one upstanding flange, each said upstanding flange having an aperture therethrough, said upstanding flange being sized and configured to proximately fit between laterally adjacent retainer flanges of the forward end portion of said handle bar for rotation between the retainer flanges of the forward end portion when all of said apertures are in alignment with each other; and iii) connecting means extending through said apertures to pivotally connect and adjustably connect said handle bar to said connection member;

b) said handle bar has a generally L-shaped configuration such that the rear end portion is upstanding; and c) said first end portion of the arm has clamp means for effecting the detachable connection between said arm and said steering column.

36. Apparatus according to claim 35, wherein said upstanding rear end portion further comprises a manually actuatable electrical switch for making and breaking an electrical circuit between the trolling motor and an electrical power source therefor.

37. Apparatus according to claim 35, wherein said clamp means comprise (a) a first clamping member, and a second clamping member integrally connected to said first end portion, said members defining between respective confronting faces thereof a generally cylindrical space sized to receive and grasp said steering column when said faces are brought into and maintained in close proximity to each other, and (b) compressing means to bring and maintain said faces in close proximity to each other.

38. A method of adjusting the position relative to a watercraft of a trolling motor mounted thereon to propel said watercraft and having an upstanding steering column adapted to be axially rotated, which method comprises a) detachably affixing to said steering column a device comprising i) an arm having first and second end portions angularly displaced from each other, wherein said first end portion is detachably connectable to said steering column and adapted, when so connected, to rotate with said steering column on the axis of said steering column up to and through 360° and wherein said second end portion is laterally displaced from the axis of said steering column and disposed above said first end portion; and ii) a handle bar having a forward end portion proximate to said second end portion and a rear end portion remote from said second end portion, said handle bar being rotatably connected to said second end portion and adapted, upon application of force to said handle bar, to cause said first and second end portions to revolve in unison around the axis of the steering column up to and through 360°; and b) applying force to said handle bar to cause said first and second end portions to revolve in unison up to and through 360° around said axis.

39. A method according to claim 38 wherein the force is manually applied to said handle bar.

40. A method according to claim 38 wherein said first end portion is detachably connectable to said steering column at an angle in the range of about 45° to about 135° relative to the direction of travel produced by the trolling motor.

41. A method according to claim 38 wherein the rotatable connection between said handle bar and said second end portion is such as to enable said first and second end portions to be revolved in unison around the axis of the steering column up to and through 360°, and wherein said force is applied to said handle bar to cause said first and second end portions to revolve to any selected angular extent around the axis of the steering column.

42. A method according to claim 41 wherein the force is manually applied to said handle bar.

43. A method according to claim 41 wherein said first end portion is detachably connectable to said steering column at an angle in the range of about 45° to about 135° relative to the direction of travel produced by the trolling motor.

* * * * *

UNITED STATES PATENT AND TRADEMARK OFFICE

CERTIFICATE OF CORRECTION

PATENT NO. : 5,660,132

DATED : August 26, 1997

INVENTOR(S) : B. Phil Pasley

It is certified that error appears in the above-identified patent and that said Letters Patent are hereby corrected as shown below:

Claim 21, Column 12, line 30, reads "leas" and should read --has--.

Claim 24, Column 13, line 3, reads "housing" and should read --housing;--.

Claim 32, Column 13, line 66, reads "axis" and should read --axial--.

Signed and Sealed this

Sixteenth Day of December, 1997

Bruce Lehman

*Attest:*

BRUCE LEHMAN

*Attesting Officer*

*Commissioner of Patents and Trademarks*